US011440772B2

(12) United States Patent
Kamada

(10) Patent No.: US 11,440,772 B2
(45) Date of Patent: Sep. 13, 2022

(54) ELEVATOR PIT LADDER APPARATUS

(71) Applicant: Mitsubishi Electric Corporation, Tokyo (JP)

(72) Inventor: Hironobu Kamada, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 454 days.

(21) Appl. No.: 16/494,769

(22) PCT Filed: Mar. 30, 2017

(86) PCT No.: PCT/JP2017/013233
§ 371 (c)(1),
(2) Date: Sep. 17, 2019

(87) PCT Pub. No.: WO2018/179211
PCT Pub. Date: Oct. 4, 2018

(65) Prior Publication Data
US 2020/0039786 A1 Feb. 6, 2020

(51) Int. Cl.
*B66B 5/00* (2006.01)
*B66B 11/00* (2006.01)
(Continued)

(52) U.S. Cl.
CPC ..... *B66B 5/0087* (2013.01); *B66B 11/0005* (2013.01); *E06C 9/06* (2013.01); *E06C 9/08* (2013.01); *E06C 9/12* (2013.01)

(58) Field of Classification Search
CPC ..... B66B 5/0087; B66B 11/0005; E06C 9/00; E06C 9/02; E06C 9/06; E06C 9/08; E06C 9/12
See application file for complete search history.

(56) References Cited

U.S. PATENT DOCUMENTS 3,575,263 A * 4/1971 Reinhard ..... E06C 9/085 182/160
3,601,220 A * 8/1971 Saucier ..... E02F 9/00 182/84
(Continued)

FOREIGN PATENT DOCUMENTS

JP 3-25478 U 3/1991
JP 10-196260 A 7/1998
(Continued)

OTHER PUBLICATIONS

International Search Report and Written Opinion dated Jul. 4, 2017 for PCT/JP2017/013233 filed on Mar. 30, 2017, 8 pages including English Translation of the International Search Report.
(Continued)

*Primary Examiner* — Michael A Riegelman
(74) *Attorney, Agent, or Firm* — Xsensus LLP

(57) ABSTRACT

A mechanism that allows a ladder to be moved to either a use position or a retracted position. The ladder can be moved from the retracted position to the use position with a minimal effort, and the ladder moves by itself from the use position to the retracted position. A pit ladder apparatus for an elevator according to the present invention includes a position change means to be provided in a fixing metal frame fixed to the hoistway and allowing a ladder to be moved to either the use position when the ladder is used or the retracted position for retracting the ladder when it is not used so as not to interfere with operation of the elevator.

16 Claims, 7 Drawing Sheets

(51) Int. Cl.

| | |
|---|---|
| ***E06C 9/08*** | (2006.01) |
| ***E06C 9/06*** | (2006.01) |
| ***E06C 9/12*** | (2006.01) |

(56) References Cited

U.S. PATENT DOCUMENTS

| | | | | |
|---|---|---|---|---|
| 6,012,545 | A * | 1/2000 | Faleide | E06C 9/085 182/127 |
| 7,721,849 | B2 * | 5/2010 | Graffy | E06C 5/02 182/127 |
| 2006/0042883 | A1 * | 3/2006 | Scott | B66B 5/005 187/351 |
| 2012/0222915 | A1 * | 9/2012 | Blaska | E06C 9/08 182/97 |
| 2019/0010759 | A1 * | 1/2019 | Snarr | E04F 17/06 |
| 2020/0039786 | A1 * | 2/2020 | Kamada | E06C 9/12 |

FOREIGN PATENT DOCUMENTS

| | | | |
|---|---|---|---|
| JP | 2000-87673 | A | 3/2000 |
| JP | 2002-89162 | A | 3/2002 |
| JP | 2004-224497 | A | 8/2004 |
| JP | 2010-64869 | A | 3/2010 |
| KR | 20200050555 | A * | 10/2020 |
| WO | WO-2020012531 | A1 * | 1/2020 |

OTHER PUBLICATIONS

Indian Office Action dated Jun. 4, 2020, issued in corresponding Indian Patent Application No. 201947035752.

* cited by examiner

ELEVATOR PIT LADDER APPARATUS

CROSS-REFERENCE TO RELATED APPLICATIONS

The present application is based on PCT filing PCT/JP2017/013233, filed Mar. 30, 2017, the entire contents of which are incorporated herein by reference.

TECHNICAL FIELD

The present invention relates to a pit ladder apparatus for an elevator used by a maintenance worker to move between an elevator hall and a pit floor.

BACKGROUND ART

An elevator is provided with a pit ladder apparatus used by a maintenance worker to go down to the pit floor. For example, a pit ladder apparatus described in Patent Document 1 is known. In a conventional pit ladder apparatus, moving the ladder from a retracted position to a use position takes up worker's time and effort. However, a pit ladder apparatus is known in which moving the ladder from the retracted position to the use position can be done easily without taking up worker's time and effort (Patent Document 1). Further, there is another configuration such that the ladder is held at the retracted position using an elastic force of a spring or the like, and the ladder is drawn out from the retracted position and moved to the use position when it is used.

PRIOR ART DOCUMENTS

Patent Document

Patent Document 1: Japanese Unexamined Patent Application Publication No. 2010-64869

SUMMARY OF THE INVENTION

Problems to be Solved by the Invention

In such a pit ladder apparatus, although a workload for moving the ladder from the retracted position to the use position is reduced, the worker needs to return the ladder from the use position to the retracted position after the use of the ladder. Thus, returning the ladder from the use position to the retracted position takes up worker's time and effort. In addition, a problem arises in that, if the worker forgets to return the ladder from the use position to the retracted position, the worker needs to go back to the pit floor again to place the ladder back in the retracted position. Further, there is another configuration such that the ladder moves by itself from the use position to the retracted position owing to an elastic force provided by a spring or the like, thereby not taking up worker's time and effort for returning the ladder from the use position to the retracted position. However, in order for the ladder not to move by itself from the retracted position (for example, hoistway wall) to the use position owing to its own weight when the ladder is not in use, a spring or the like that provides an elastic force to be able to hold the ladder at the retracted position against the weight of the ladder is necessary. Thus, when the ladder is used and drawn out from the retracted position to the use position, a force exceeding the elastic force that is preset is required. Then, the worker needs to lean out of the elevator hall and may possibly falls into the pit when losing the balance.

The present invention is devised to solve the problems described above and an object is to provide a pit ladder apparatus in which the ladder can be moved from the retracted position to the use position without a light workload, and the ladder moves by itself from the use position to the retracted position without taking up the worker's time and effort.

Means for Solving Problem

Advantageous Effects of the Invention

A pit ladder apparatus for an elevator according to the present invention includes a position change means to be provided in a fixing metal frame fixed to the hoistway, the position change means allowing a ladder to be moved to either a use position where the ladder is used or a retracted position for retracting the ladder when it is not used so as not to interfere with operation of an elevator, wherein in the position change means, a mounting arm supported so as to swing freely in a seesaw manner is provided, the ladder is mounted to one end of the mounting arm and a counter weight is mounted to the other end of the mounting arm, and a moment on the side of the counter weight is set larger than a moment on the side of the ladder.

According to the present invention, the position change means that allows the ladder to be moved to either the use position or the retracted position can seesaw the ladder and the counter weight. Thus, with this means, an elevator pit ladder apparatus can be provided in which the ladder can be moved from the retracted position to the use position with a light workload, and the ladder moves by itself from the use position to the retracted position without taking up the worker's time and effort.

EMBODIMENTS FOR CARRYING OUT THE INVENTION

Embodiment 1

Figure 1:
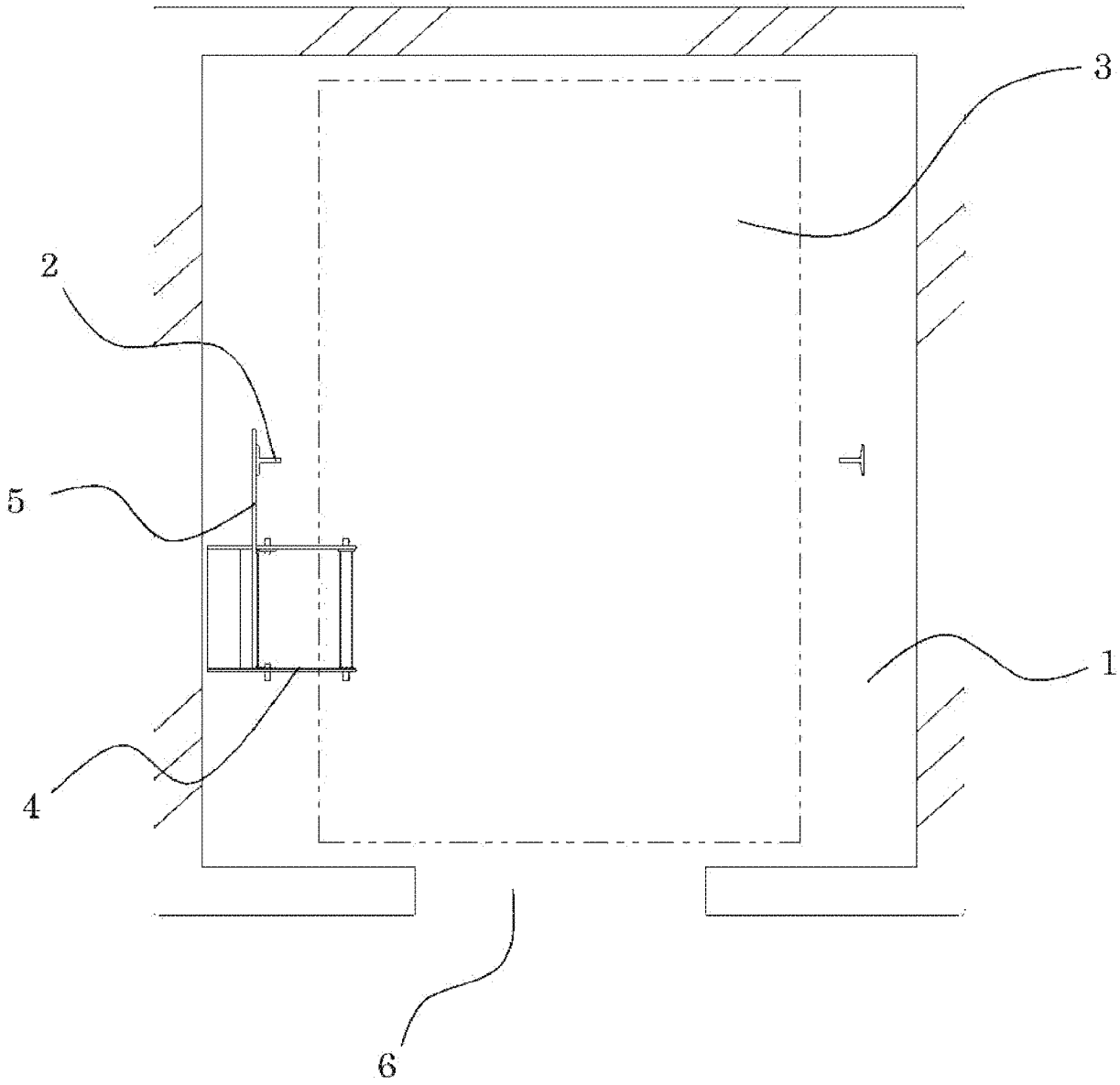
FIG. 1 is a plan view showing an entire pit ladder apparatus that is in use according to Embodiment 1 of the present invention.
Figure 2:
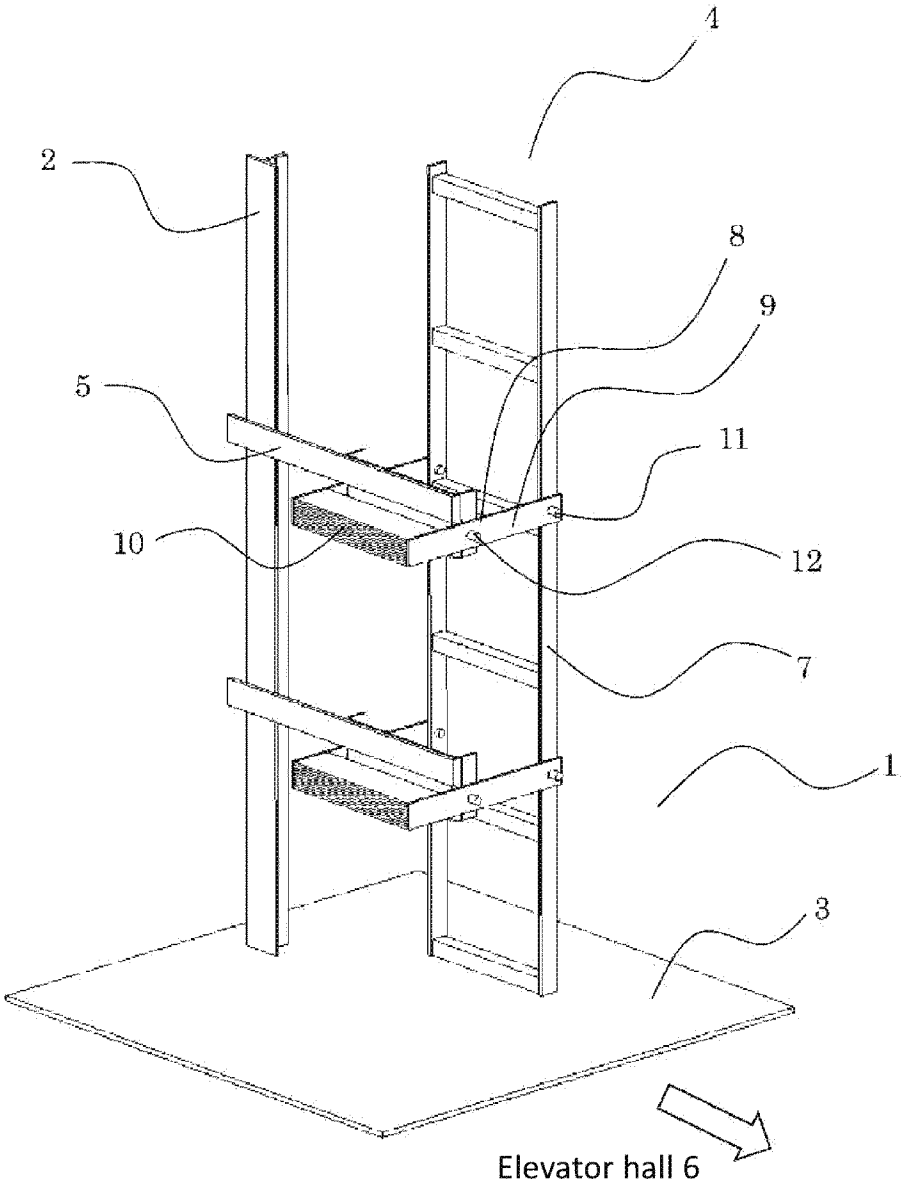
FIG. 2 is a perspective view showing the pit ladder apparatus of FIG. 1 according to Embodiment 1 of the present invention.
Figure 3:
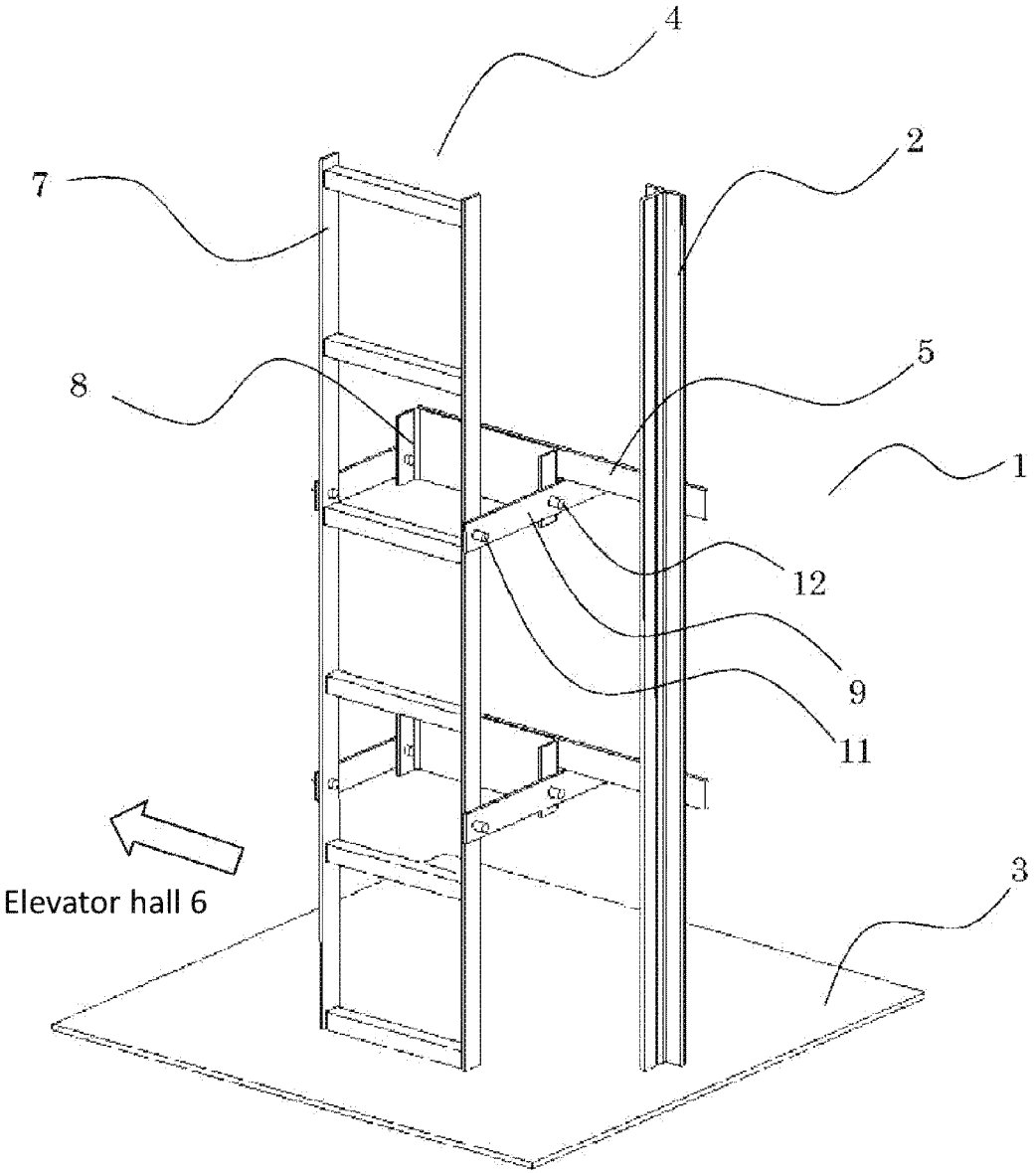
FIG. 3 is a perspective view of the pit ladder apparatus of FIG. 2, seen from a different direction according to Embodiment 1 of the present invention.
Figure 4:
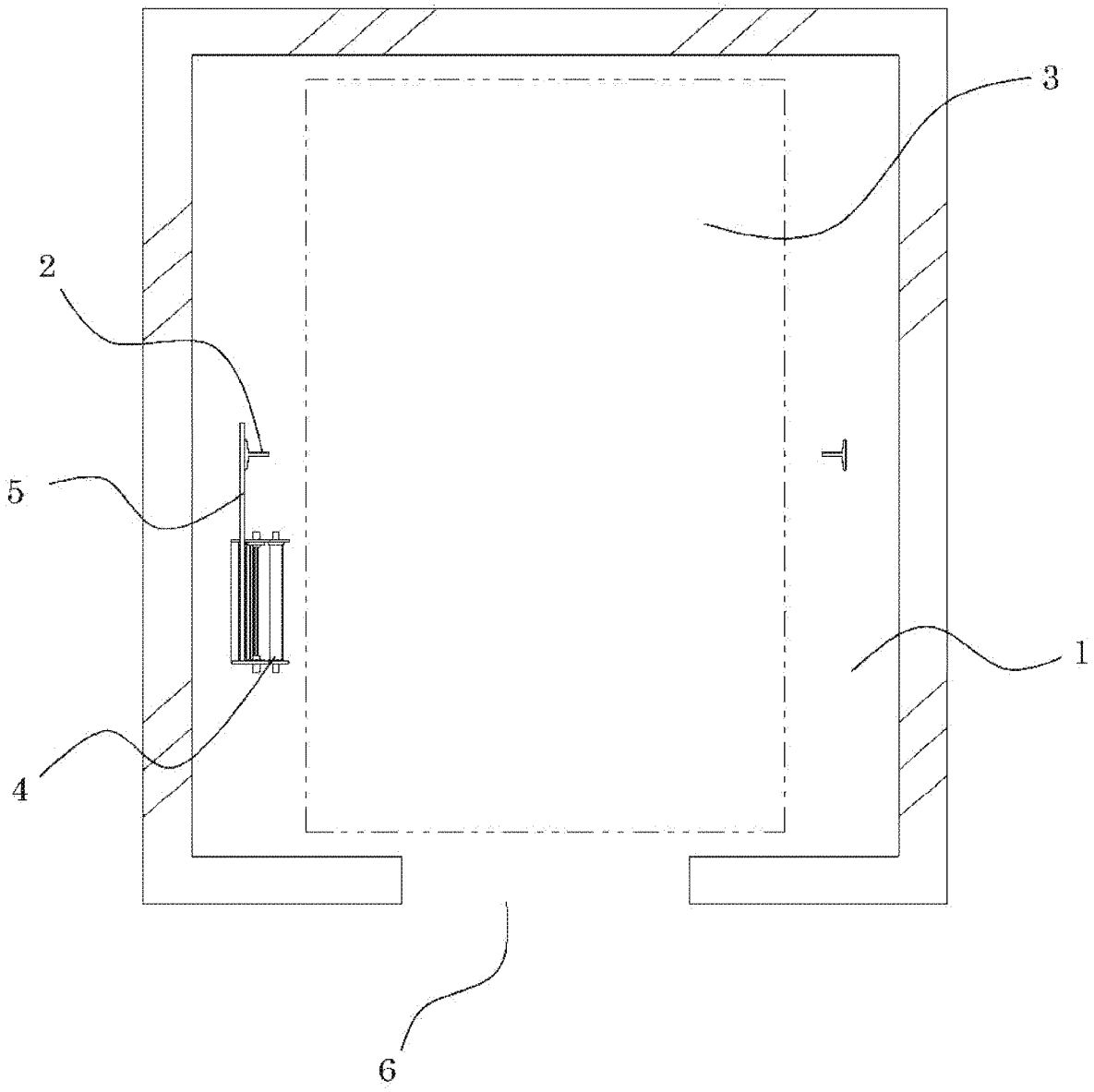
FIG. 4 is a plan view showing the entire pit ladder apparatus in its retracted state according to Embodiment 1 of the present invention.
Figure 5:
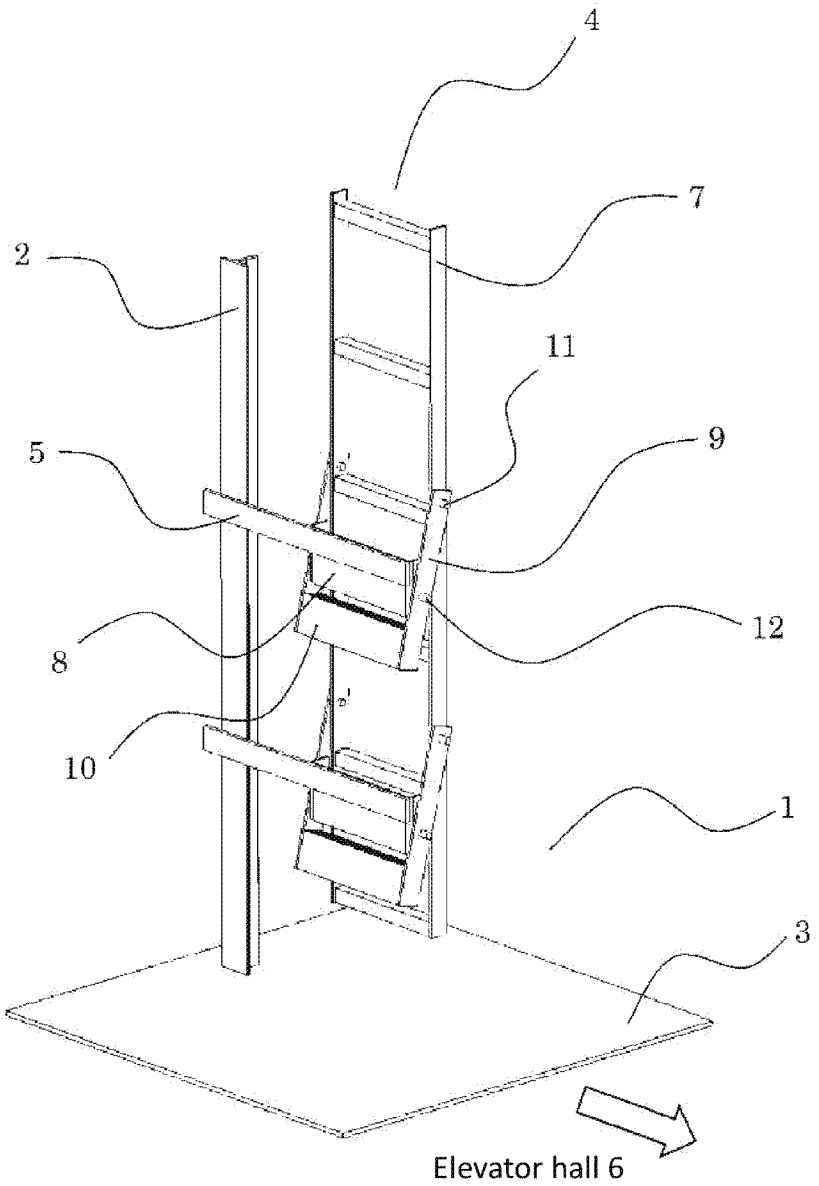
FIG. 5 is a perspective view showing the pit ladder apparatus of FIG. 4 according to Embodiment 1 of the present invention.
Figure 6:
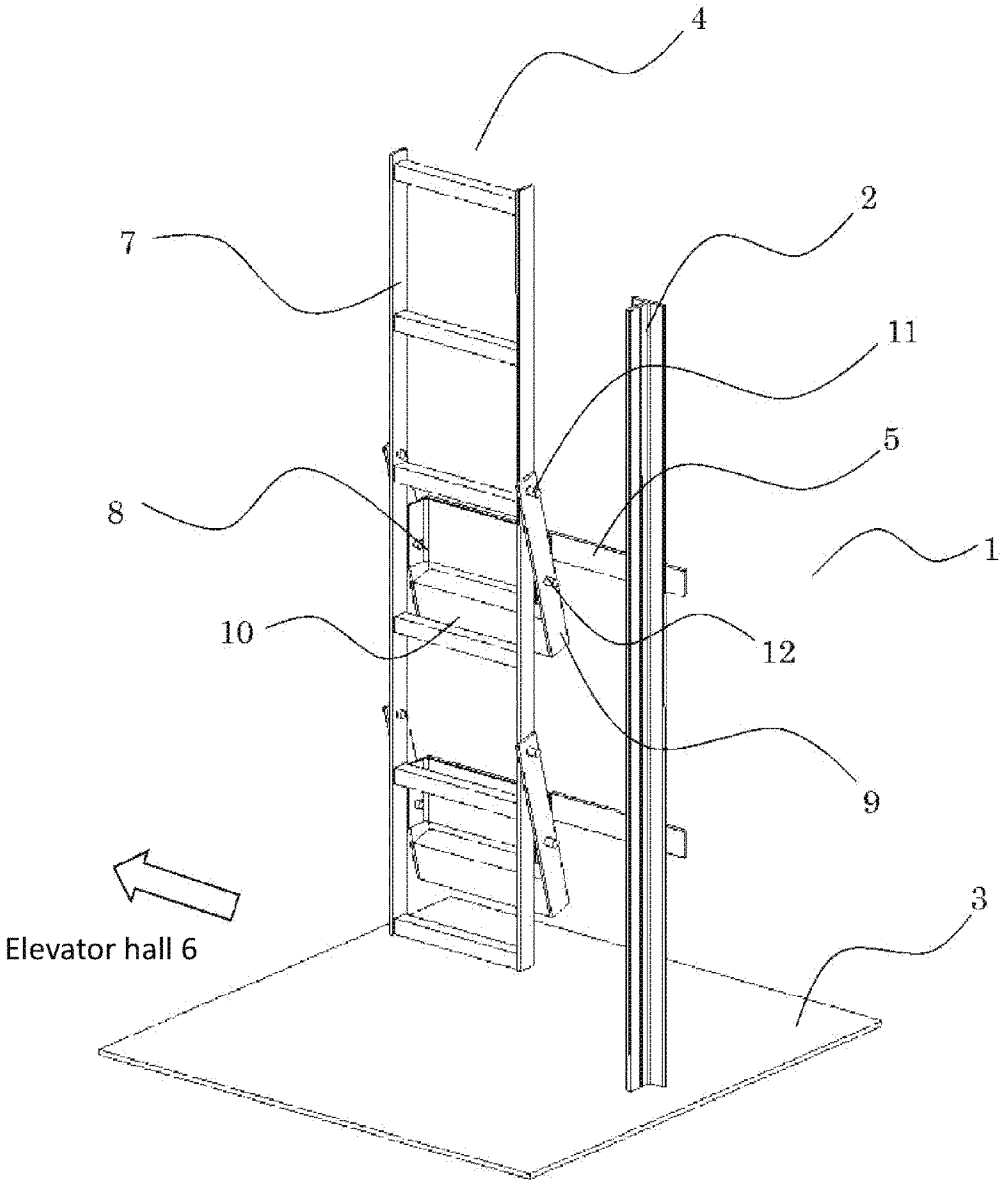
FIG. 6 is a perspective view showing the pit ladder apparatus of FIG. 5, seen from a different direction according to Embodiment 1 of the present invention.

FIGS. 1 to 6 illustrate an elevator pit ladder apparatus according to Embodiment 1 of the present invention. FIG. 1 is a plan view showing the entire pit ladder apparatus in use. FIG. 2 is a perspective view showing the pit ladder apparatus of FIG. 1. FIG. 3 is a perspective view showing the pit ladder apparatus of FIG. 2, seen from a different direction. FIG. 4 is a plan view showing the entire pit ladder apparatus in its retracted state. FIG. 5 is a perspective view showing the pit ladder apparatus of FIG. 4. FIG. 6 is a perspective view showing the pit ladder apparatus of FIG. 5, seen from a different direction.

In the figures, in an elevator hoistway 1, a guide rail 2 is standing vertically to guide an elevator car. In a pit area 3 inside the hoistway 1, a pit ladder apparatus 4 is fixed to the guide rail 2 via a fixing metal frame 5. The pit ladder apparatus 4 is disposed at a position where the pit ladder apparatus 4 does not interfere with operation of the elevator and the worker can reach out to the pit ladder apparatus 4 from the elevator hall 6. The pit ladder apparatus 4 includes a ladder 7 and position change units 8 that allow the ladder 7 to be moved to either a use position where the ladder is used or a retracted position for retracting the ladder. Each of the position change unit 8 includes mounting arms 9 and a counter weight 10 that is mounted to first ends of the mounting arms 9. The ladder 7 is mounted to second ends of the mounting arms 9 so as to seesaw the ladder 7 and the counter weight 10. The position change units 8 are each provided on the upper and lower side of the ladder 7, and they are mounted to the guide rail 2 via the fixing metal frame 5.

The mounting arms 9 are a pair and disposed apart from each other in the horizontal direction. The counter weight 10 is mounted to the first ends of the mounting arms 9 so as to be sandwiched between them. The ladder 7 is mounted to the second ends of the mounting arms 9 so as to be sandwiched between them. Rotation shafts 11 are arranged in the horizontal direction at the second ends of the mounting arms 9. The ladder 7 is disposed in such a way that the longitudinal direction thereof corresponds to the vertical direction, and it is mounted to the rotation shafts 11 at side faces of supporting legs that constitute the ladder 7 and on the upper side than the center of gravity of the ladder 7. That is, the ladder 7 is mounted to the second ends of the mounting arms 9 so as to be freely rotatable via the rotation shafts 11.

Between the ladder 7 and the counter weight 10 that are provided at either ends of the mounting arms 9, rotation shafts 12 are provided to support the mounting arms 9 so that the mounting arms can swing freely in a seesaw manner. The rotation shafts 12 are disposed in the horizontal direction and mounted to the position change units 8. When the mounting arms 9 swing in a seesaw manner around the rotation shafts 12 as a pivot, the counter weight 10 provided at the first ends of the mounting arms 9 is displaced and moves up and down along with the swing of the mounting arms 9. Further, the ladder 7 provided at the second ends of the mounting arms 9 is displaced and moves down and up along with the swing of the mounting arms 9. At this moment, the ladder 7 rotates with respect to the mounting arms 9 via the rotation shafts 11 while being suspended by the rotation shafts 11. Then, because the lower part of the ladder 7 below the rotation shafts 11 is heavier, the ladder 7 supported by the rotation shafts 11 is moved while disposed to keep the longitudinal direction thereof in the vertical direction.

The ladder 7 and the counter weight 10 that are provided at either ends of the mounting arms 9 are seesawed around the rotation shafts 12 as a pivot. Here, regarding a balance, the balance between the moment on the side of the ladder 7 and the moment on the side of the counter weight 10 is adjusted. That is, the moment on the side of the ladder 7 is expressed by the product of the weight W1 of the ladder 7 and the distance L1 from the rotation shafts 12 to the ladder 7. The moment on the side of the counter weight 10 is expressed by the product of the weight W2 of the counter weight 10 and the distance L2 from the rotation shafts 12 to the counter weight 10. Namely, regarding the balance between the moments, the moment on the side of the ladder 7 and the moment on the side of the counter weight 10 are set so as to satisfy the following relational expression (1).

$$W1 \times L1 < W2 \times L2 \quad (1)$$

Next, operation of the pit ladder apparatus 4 according to Embodiment 1 will be described. In the case where the ladder in the pit ladder apparatus 4 is to be disposed at the retracted position, the weights of the ladder 7 and the counter weight 10 as well as distances from the rotation shafts 12 to the ladder 7 and to the counter weight 10 are adjusted in advance so as to satisfy the relational expression (1) regarding the balance of the moments. As a result, regarding the mounting arms 9 configured in a seesaw manner, with respect to the rotation shafts 12, the side of the counter weight 10 having a larger moment goes up and the side of the ladder 7 having a smaller moment goes down. Thus, the mounting arms 9 is moved so as to dispose the ladder 7 in a higher position and the counter weight 10 in a lower position. At this moment, while the longitudinal direction of the ladder 7 is kept in the vertical direction, the counter weight 10 is inclined and goes down toward the ladder 7 together with the mounting arms 9, so that the ladder 7 and the counter weight 10 are disposed close to each other. That is, when the pit ladder apparatus 4 is viewed from the top, a state in which the ladder 7 and the counter weight 10 are disposed closest to each other corresponds to the state in which the ladder is disposed at the retracted position.

Next, in the case where the ladder 7 in the pit ladder apparatus 4 is to be disposed at the use position, similarly to the case of the retracted position, the weights of the ladder 7 and the counter weight 10 as well as the distances from the rotation shafts 12 to the ladder 7 and to the counter weight 10 are adjusted in advance so as to satisfy the relational expression (1) regarding the moment balance. Note that, an adjustment may be the same as in the case of the placement of the retracted position. However, the adjustment is preferably made in such a manner that W2×L2 is larger than W1×L1 and the difference between them is set as small as possible. Here, the moment F required to draw out the ladder 7 from the retracted position to the use position is expressed by the following relational expression (2).

$$F = W2 \times L2 - W1 \times L \quad (2)$$

That is, when the ladder 7 is drawn out from the retracted position to the use position, the moment that resists and exceeds F of the relational expression (2) is required. If F is adjusted to be small, the moment that resists and exceeds F can be made small, so that the ladder 7 can be drawn out from the retracted position to the use position with a minimum moment required. Therefore, the weights of the ladder 7 and the counter weight 10 as well as the distances from the rotation shafts 12 to the ladder 7 and to the counter weight 10 are adjusted in advance using the relational expression (2) so that W2×L2 can be made larger than W1×L1 and F can be made as small as possible.

Thus, when the worker reaches out, from the elevator hall 6, to the ladder 7 placed at the retracted position and moves the ladder 7 to the use position, the worker can move the ladder 7 by just applying the moment against F that is adjusted to be small in advance. Further, when the ladder 7 is in use, the worker's weight is always applied thereon, and the moment due to the worker's weight is sufficiently larger than F, and thus the ladder 7 can be placed stably at the use position. After use, when the worker is off from the ladder 7, the relational expression (1) is satisfied in the pit ladder apparatus 4, so that the ladder returns by itself from the use position to the retracted position and placed therein.

As described above, according to Embodiment 1, a pit ladder apparatus 4, which is provided in a hoistway 1 of an elevator and used for the access between an elevator hall 6 and a pit, includes position change units 8. The position change units 8 are provided to the fixing metal frame 5 fixed to the hoistway 1, and allow the ladder 7 to be moved to either the use position where the ladder is used or the retracted position for retracting the ladder when it is not used so as not to interfere with operation of the elevator. In the position change units 8, mounting arms 9 that are supported thereby to swing freely in a seesaw manner are provided. The ladder 7 is provided at the second ends of the mounting arms 9. The counter weight 10 is provided at the first ends of the mounting arms 9. The moment on the side of the counter weight 10 is set larger than the moment on the side of the ladder 7, so that the pit ladder apparatus can be provided in which the ladder 7 can be moved from the retracted position to the use position with a light workload, and the ladder moves by itself from the use position to the retracted position without taking up the worker's time and effort.

As described above, according to Embodiment 1, the mounting arms 9 are a pair and disposed apart from each other in the horizontal direction. A pair of first rotation shafts 11 are provided at the second ends of the paired mounting arms 9. The counter weight 10 is mounted at the first ends of the paired mounting arms 9 so as to be sandwiched between the paired mounting arms 9. The ladder 7 is mounted to the first rotation shafts 11 so as to be freely rotatable on the upper side than the center of gravity of the ladder 7. Between the ladder 7 and the counter weight 10 that are provided at either ends of the mounting arms 9, rotation shafts 12 are provided to support the paired mounting arms 9 so that the mounting arms can swing freely in a seesaw manner. Therefore, a pit ladder apparatus can be provided in which the ladder 7 can be moved from the retracted position to the use position with a light workload, and the ladder moves by itself from the use position to the retracted position without taking up the worker's time and effort.

Embodiment 2

Figure 7:
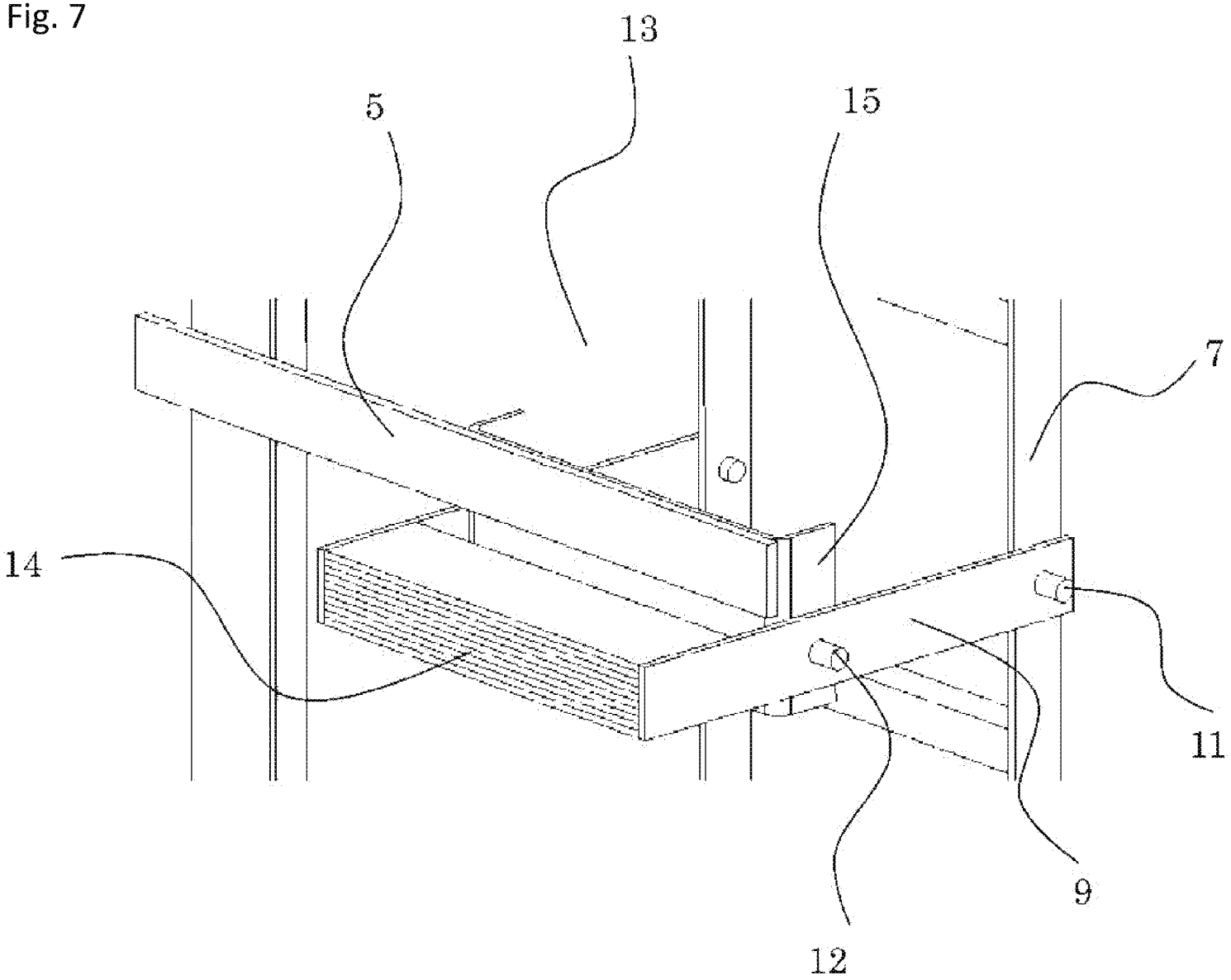
FIG. 7 is a perspective view showing a main part of a pit ladder apparatus according to Embodiment 2 of the present invention.

FIG. 7 is a perspective view to illustrate a main part of a pit ladder apparatus 13 according to Embodiment 2 of the present invention. According to Embodiment 2 of the present invention, the difference from Embodiment 1 is that a counter weight 14 of the pit ladder apparatus 13 is made up of stacked weights. The same or equivalent components other than the difference are given the same symbols and their description will be omitted.

As shown in the figure, the counter weight 14 is made up of stacked weights. The minimum unit of the weights corresponds to a single weight that is formed to be a flat plate. Flat plates having the same shape as the flat plate described above are disposed and the number is selectable and either one or plural.

Next, operation of the pit ladder apparatus 13 according to Embodiment 2 will be described. Referring to the figure, the weights of the ladder 7 and the counter weight 14 in a position change unit 15 as well as the distances from the rotation shafts 12 to the ladder 7 and to the counter weight 14 are adjusted in advance using the relational expression (1) and the relational expression (2). In adjusting the weight of the counter weight 14, first, a plurality of flat plate weights are stacked and disposed. Next, in order to adjust the moment balance against the ladder 7 in the position change unit 15, one or more flat plates are added to or taken out from the weights disposed, so that the weight of the counter weight 14 is optimally adjusted regarding the balance.

As described above, according to Embodiment 2, the counter weight 14 is made up of stacked weights. Thereby, in accordance with the weights of the ladder 7 and the counter weight 14 as well as the distances from the rotation shafts 12 to the ladder 7 and to the counter weight 14, the weight of the counter weight 14 is adjusted by adding or taking out one or more flat plates making up the counter weight 14. Thus, the weight of the counter weight 14 can be adjusted only by increasing or decreasing the number of the flat plates making up the counter weight 14, so that the balance of the moments in the position change unit 15 can be easily adjusted.

Embodiment 3

FIG. 2 and FIG. 3 illustrate a pit ladder apparatus 4 according to Embodiment 3 of the present invention. The pit ladder apparatus 4 according to Embodiment 3 of the present invention is different from the previous embodiments in that a lower end of the ladder 7 at the use position is in contact with a pit floor of the pit area 3. The same or equivalent components other than the difference are given the same symbols and their description will be omitted.

As shown in the figures, the lower end of the ladder 7 at the use position is disposed to be in contact with the pit floor of the pit area 3. Next, operation of the pit ladder apparatus 4 according to Embodiment 3 will be described. Referring to figures, when a worker moves up and down on the ladder 7 at the use position, a load applied as the worker moves up and down is applied from the ladder 7 to the guide rail 2 via the mounting arms 9 and the fixing metal frame 5. At this time, strength is needed for the guide rail 2 to withstand the load applied from the pit ladder 7. Otherwise, there is at risk that the guide rail 2 may be deformed by the load.

Further, the strength of the guide rail 2 is determined in such a way that a prescribed safety factor is secured in accordance with the specifications such as capacity and speed of an elevator car, and an elevation height. In a case of an elevator car in which the capacity, the speed, and the elevation height are low, however, the guide rail tends to have low strength. Thus, in such a case, the strength of the guide rail 2 may not be sufficient for the safe use of the pit ladder 7.

In the case described above, even in the case where the criteria for use of an elevator is satisfied, the strength of the guide rail 2 needs to be increased only for the use of the pit ladder 7. However, when the lower end of the ladder 7 at the use position is made in contact with the pit floor of the pit area 3, the load that will be otherwise applied to the guide rail 2 is supported by the lower end of the ladder 7. Thus, the load applied to the guide rail 2 can be significantly reduced when the pit ladder 7 is in use.

As described above, according to Embodiment 3, the lower end of the ladder 7 at the use position is disposed to be in contact with the pit floor of the pit area 3. Thus, since the load that will be otherwise applied to the guide rail 2 is mostly supported at the lower end of the ladder 7, the load applied to the guide rail 2 can be significantly reduced. Further, the load applied to the guide rail 2 is significantly reduced, so that the strength for the guide rail 2 is allowed to be reduced to a minimum.

Note that, two position change units 8 are provided to the ladder 7 on its upper side and its lower side in Embodiment 1. Instead, one position change unit 8 may be provided on its upper side. That is, at least one position change unit 8 needs to be provided at a portion above the center of gravity of the ladder 7.

In Embodiment 2, although the minimum unit of the counter weight 14 corresponds to a single flat plate, the shape thereof does not have to be flat. For example, the minimum unit of the counter weight 14 corresponds to a block-shaped or spherical weight. Furthermore, it goes without saying that the same function and effect can be achieved by providing a holding case in which the number of weights can be easily increased or decreased and the weight is held in one or more units.

DESCRIPTION OF SYMBOLS

1 hoistway,
2 guide rail,
3 pit area,
4, 13 pit ladder apparatus,
5 fixing metal frame,
6 elevator hall,
7 ladder,
8, 15 position change unit,
9 mounting arm,
10, 14 counter weight,
11, 12 rotation shaft

INDUSTRIAL APPLICABILITY

The present invention relates to a pit ladder apparatus for an elevator used by a maintenance worker to move between an elevator hall and a pit floor.

The invention claimed is:

1. A pit ladder apparatus for use in a hoistway of an elevator to access between an elevator hall and a pit, the pit ladder apparatus comprising:

a ladder; and a position change means to be fixed to the hoistway, the position change means for moving the ladder to either a use position where the ladder is used or a retracted position for retracting the ladder when not used so as not to interfere with operation of the elevator, the position change means including a counter weight and one or more mounting arms that are supported so as to swing freely in a seesaw manner, wherein the ladder is mounted to one end of each of the mounting arms, the counter weight is mounted to the other end of each of the mounting arms, and a moment on a side of the counter weight is set larger than a moment on a side of the ladder.

2. The pit ladder apparatus for an elevator according to claim 1, wherein:

a pair of the mounting arms is disposed apart from each other in a horizontal direction, a first rotation axis is located at one end of the pair of mounting arms, the counter weight is mounted to another end of the pair of mounting arms so as to be sandwiched between them, the ladder is mounted to the first rotation axis so as to be freely rotatable on a side higher than a center of gravity of the ladder, and a second rotation axis is located between the ladder and the counter weight to support the pair of mounting arms so that the pair of mounting arms can swing freely in the seesaw manner, and the ladder and the counter weight are disposed at either end of the pair of mounting arms.

3. The pit ladder apparatus for an elevator according to claim 2, wherein the counter weight includes stacked weights.

4. The pit ladder apparatus for an elevator according to claim 3, wherein a lower end of the ladder at the use position is disposed to be in contact with a pit floor.

5. The pit ladder apparatus for an elevator according to claim 2, wherein a lower end of the ladder at the use position is disposed to be in contact with a pit floor.

6. The pit ladder apparatus for an elevator according to claim 1, wherein the counter weight includes stacked weights.

7. The pit ladder apparatus for an elevator according to claim 6, wherein a lower end of the ladder at the use position is disposed to be in contact with a pit floor.

8. The pit ladder apparatus for an elevator according to claim 1, wherein a lower end of the ladder at the use position is disposed to be in contact with a pit floor.

9. A pit ladder apparatus for use in a hoistway of an elevator to access between an elevator hall and a pit, the pit ladder apparatus comprising:

a ladder; and a counter weight and one or more mounting arms that are pivotally supported to move the ladder to either a use position where the ladder is used or a retracted position for retracting the ladder when not used so as not to interfere with operation of the elevator, wherein the ladder is mounted to one end of each of the mounting arms, the counter weight is mounted to the other end of each of the mounting arms, and a moment on a side of the counter weight is set larger than a moment on a side of the ladder.

10. The pit ladder apparatus for an elevator according to claim 9, wherein:

a pair of the mounting arms is disposed apart from each other in a horizontal direction, a first rotation axis is located at one end of the pair of mounting arms, the counter weight is mounted to another end of the pair of mounting arms so as to be sandwiched between them, the ladder is mounted to the first rotation axis so as to be freely rotatable on a side higher than a center of gravity of the ladder, and a second rotation axis is located between the ladder and the counter weight to support the pair of mounting arms so that the pair of mounting arms can swing freely in a seesaw manner, and the ladder and the counter weight are disposed at either end of the pair of mounting arms.

11. The pit ladder apparatus for an elevator according to claim 10, wherein the counter weight includes stacked weights.

12. The pit ladder apparatus for an elevator according to claim 11, wherein a lower end of the ladder at the use position is disposed to be in contact with a pit floor.

13. The pit ladder apparatus for an elevator according to claim 10, wherein a lower end of the ladder at the use position is disposed to be in contact with a pit floor.

14. The pit ladder apparatus for an elevator according to claim 9, wherein the counter weight includes stacked weights.

15. The pit ladder apparatus for an elevator according to claim 14, wherein a lower end of the ladder at the use position is disposed to be in contact with a pit floor.

16. The pit ladder apparatus for an elevator according to claim 9, wherein a lower end of the ladder at the use position is disposed to be in contact with a pit floor.

* * * * *